US009321555B2

(12) United States Patent
Roodnat et al.

(10) Patent No.: US 9,321,555 B2
(45) Date of Patent: Apr. 26, 2016

(54) STACKABLE DRINKING VESSEL

(75) Inventors: Stijn Roodnat, Landsmeer (NL); Erna Gerritdina Hendrika Wilbrink, Amersfoort (NL)

(73) Assignee: Coöperatieve Vereniging 4WiHo U.A., Amersfoort (NL)

( * ) Notice: Subject to any disclaimer, the term of this patent is extended or adjusted under 35 U.S.C. 154(b) by 0 days.

(21) Appl. No.: 14/130,686

(22) PCT Filed: Jul. 4, 2011

(86) PCT No.: PCT/EP2011/061249

§ 371 (c)(1), (2), (4) Date: Jan. 3, 2014

(87) PCT Pub. No.: WO2013/004294

PCT Pub. Date: Jan. 10, 2013

(65) Prior Publication Data

US 2014/0144804 A1 May 29, 2014

(51) Int. Cl.

| | |
|---|---|
| ***B65D 1/02*** | (2006.01) |
| ***B65D 21/02*** | (2006.01) |
| ***A47G 19/23*** | (2006.01) |
| ***B65D 1/26*** | (2006.01) |

(52) U.S. Cl.

CPC ..... *B65D 21/023* (2013.01); *A47G 19/23* (2013.01); *B65D 1/265* (2013.01); *B65D 21/0233* (2013.01); *B65D 21/0235* (2013.01)

(58) Field of Classification Search

CPC ..... A47G 19/23; B65D 1/265; B65D 21/023; B65D 21/0233; B65D 21/0235

USPC ..... 215/10; 206/511; 220/23.6, 23.83

See application file for complete search history.

(56) References Cited

U.S. PATENT DOCUMENTS

| | | | | | |
|---|---|---|---|---|---|
| 3,528,585 | A | * | 9/1970 | Kalmar | 206/509 |
| 4,057,931 | A | * | 11/1977 | Stutelberg et al. | 47/83 |
| D375,871 | S | | 11/1996 | Jarvis | |
| 6,134,832 | A | * | 10/2000 | Bokmiller et al. | 47/66.1 |
| D469,306 | S | * | 1/2003 | Lipson | D7/507 |
| 7,623,767 | B2 | * | 11/2009 | Chu | 386/327 |
| 7,946,422 | B1 | * | 5/2011 | Bjerke | 206/546 |
| 2011/0220665 | A1 | * | 9/2011 | McDonnell et al. | 220/592.17 |

FOREIGN PATENT DOCUMENTS

| | | | | |
|---|---|---|---|---|
| DE | 202010009758 | U1 | | 11/2010 |
| GB | 2102638 | | | 7/2001 |
| GB | 2475918 | A | * | 6/2011 |
| JP | 6121726 | A | | 5/1994 |
| JP | 406121726 | A | * | 5/1994 |
| NL | 1026890 | C | | 2/2006 |
| WO | 9410054 | A1 | | 5/1994 |
| WO | 2007056815 | A1 | | 5/2007 |

OTHER PUBLICATIONS

International Search Report of PCT/EP2011/061249.

* cited by examiner

*Primary Examiner* — Sue A Weaver

(74) *Attorney, Agent, or Firm* — Ramin Amirsehhi; David P. Owen; Hoyng Rokh Monegier LLP

(57) ABSTRACT

There is provided a stackable drinking vessel comprising a rim at an open end of the vessel, a base, and a vessel body between the rim and the base, wherein the base comprises stack-elements simultaneously engageable with at least a rim of a first similar drinking vessel and a rim of a second similar drinking vessel, whereby the vessel can be stacked upon the at least two similar drinking vessels.

18 Claims, 5 Drawing Sheets

STACKABLE DRINKING VESSEL

BACKGROUND OF THE INVENTION

1. Field of the Invention

The invention relates generally to a stackable drinking vessel and more particularly to a stackable drinking vessel that can stack and be carried in a stack by hand whilst the drinking vessel contains beverage. The invention further relates to a stack of drinking vessels, and to a method of serving beverage in a stackable drinking vessel or a stack of such drinking vessels.

2. Description of the Related Art

It is typical audience behaviour at large events such as sports matches, music concerts and festivals, to buy and consume beverages. It is common that the beverages are served into drinking vessels such as glasses of various sorts, tumblers and the like, at a bar and that a consumer then carries these vessels by hand to his or her seat or standing location. Because of crowded conditions at such events it is typical for a consumer to purchase more than one beverage per bar visit, and also for one consumer to purchase beverages for a group of persons. Depending upon the size and shape of the vessel a single person can normally carry two purchased beverages by hand with ease, may be able to carry three beverages by hand, and in some cases may even be able to carry as many as four beverages without additional assistance, although spillage is naturally more likely.

Stacking of filled drinking vessels one upon the other in a single column has been suggested in the prior art. For example, WO2007056815 discusses a filled, disposable drinking vessel, which can be stacked onto a similar drinking vessel for storage and transportation. The stacking of the drinking vessel is achieved in a manner by which the base of one vessel sits over or within the rim of a single other similar drinking vessel to form a mono-column. Although the stacking mechanism is primarily discussed in terms of storage of the drinking vessels, it is shown that a mono-column of at most two drinking vessels can be carried in one hand when stabilized by a user's thumb. Although this reduces the skill level needed to carry four such drinking vessels, it remains problematic, and the carrying of more than four such vessels by hand appears not to be possible.

To overcome these problems bars may provide disposable or reusable trays with which full drinking vessels can be more securely carried. However, reusable trays are expensive and must be retrieved, and disposable trays are expensive and wasteful.

There remains a need for a more convenient manner of carrying multiple beverage vessels by hand.

BRIEF SUMMARY OF THE INVENTION

According to the present invention there is provided a stackable drinking vessel comprising a rim at an open end of the vessel, a base, and a vessel body between the rim and the base, wherein the base comprises stack-elements that enable the base to be simultaneously engaged with at least a rim of a first similar drinking vessel and a rim of a second similar drinking vessel. In this manner the stackable drinking vessel can be stably stacked upon at least two similar drinking vessels.

Further addition of similar vessels to the stack in a similar manner allows construction of a unitary stack of an extended number of securely interlocked drinking vessels stacked rim to base.

By stable stacking is meant that a stack of the drinking vessels is stable enough that it can be carried by hand, even when filled with beverage. This, in particular, when carrying such a stack through large crowds where walking room is restricted and bumping of other persons in the crowd is likely. In this respect it will be evident that the drinking vessels of this invention differ from drinking vessels that stack into static pyramids, for example champagne pyramids, because such pyramids are far too unstable to move, let alone by hand.

Preferably the stacking is so stable that when stacked onto the rims of at least two other drinking vessels, a drinking vessel has a tilt of no more than 12°, preferably no more than 11°, and most preferably no more than 10°, compared to either of the vessels upon which it is stacked. The tilt of a drinking vessel is the degree of tilt of the main axis of the drinking vessel in comparison to either of the main axes of the vessels upon which it is stacked.

Since the drinking vessels are stacked with the bases of the upper layers on the rims of the lower layers, there is little or substantially no intrusion of the upper drinking vessels into the container volumes of the lower drinking vessels. This allows each of the drinking vessels to be filled with beverage when stacked in the rim to base manner.

The stacking system of the invention makes it possible to carry by hand a stack of filled drinking vessels by grasping the vessels in the lowest layer of the stack and lifting. Vessels within the upper layers of the stack are securely held in place by the engagement of their bases with the rims of the vessels in the layer immediately below them and adjacent vessels within each layer are further securely held laterally in relation to one another by engagement of their own rims with the base or bases of the vessel or vessels in the layer immediately above.

Preferably the stacking elements are in the form of at least two grooves in the base of the drinking vessel. Each of the grooves is shaped to closely fit over the rim of the similar drinking vessel onto which the drinking vessel is stacked.

The grooves preferably extend substantially vertically in the base for from 1 to 20% of the total height of the drinking vessel, more preferably from 3 to 18%, even more preferably from 5 to 15%, and most preferably from 7 to 12%. By selecting the depth of the groove or grooves with respect to the overall height of the drinking glass, the stability of the stack of the drinking vessels can be optimized.

As shown in FIG. 8, the grooves preferably have a width 23 that matches with the thickness 24 of the rim, so that a rim of that thickness can closely and securely received therein. Preferably the rim has a width of from 101% to 130%, more preferably from 105% to 130%, even more preferably 105% to 120%, and most preferably 105% to 115% of the thickness of the rim.

The groove or grooves have at least partly a complementary shape to that of the rim of the drinking glass so that the rim can fit into the groove or grooves. The groove or grooves can also have a varying inner width, for example a narrowed width within the groove or grooves, e.g. by inclusion of an internal solid or flexing protrusion. This may provide additional stability or add a click-in mechanism to the stack elements.

By provision of grooves with enough depth and a form closely fitting the rim the tilt of the stacked drinking vessels can be controlled.

The rim of the drinking vessel preferably has the form of a side wall extending upwardly from the body of the vessel. In some embodiments the rim is distinct from the vessel body (e.g. in terms of diameter or angle of elongation) and in other embodiments runs seamlessly into the vessel body. The rim side wall may generally have a thickness of from 0.2 to 5 mm thick, preferably of from 0.7 to 4 mm thick, more preferably of from 1.2 to 4 mm.

The base of the drinking vessel preferably has the form of a side wall extending downwardly from a bottom of the vessel body of the vessel, the bottom of the vessel body being the lower wall defining the bottom of the vessels containment volume. The thickness of the base side wall may generally of from 0.2 to 5 mm, preferably of from 0.7 to 4 mm, more preferably of from 1.2 to 4 mm.

It is preferred that the sidewall extends substantially vertically downwardly. Preferably the base sidewall extends downwardly for between 4 to 25% of the total height of the drinking vessel, more preferably 5 to 20% and most preferably from 7 to 15%.

The grooves preferably take the form of slots within the base side wall, the slots have a shape to closely fit onto the rim of a similar drinking vessel. In such an embodiment at least four slots are provided spaced, preferably equally spaced, about the periphery of the base side wall.

When stacking the rim of a similar drinking vessel into the base of such an embodiment the rim fits into two of the slots, and the rim of the second similar drinking vessel fits into the other two slots. More than four slots may be provided, which may be advantageous in terms of ease of stacking.

In an alternative embodiment the grooves may take the form of elongate furrows each comprising one or more curved sidewalls matching the curvature of the rim of the drinking vessel so that the rim of a similar drinking vessel can slide into the furrow. Other forms of grooves can be envisaged, e.g. partial furrow, or elongated slots, so long as the grooves stably received the rim of another similar drinking vessel.

Although it is preferred that only two similar drinking vessels are engaged with the single base of a drinking vessel, it is envisaged that three, four or possibly more similar drinking vessels may be engaged with a single base. The number of grooves, slots and/or furrows being increased accordingly.

The drinking vessels of the present invention are commonly referred to as glasses. As is well known, although the generic name for such vessels is 'glasses' the usage of this term refers to the form of the vessel and not to the material of construction. Hence 'glasses' as used herein refers to at least plastic glasses such as those made from, for example, PET or polypropylene. Other materials from which the glasses can be made include glass, waxed cardboard, ceramics, metal or a combination thereof.

The invention is preferably embodied as a stackable glass preferably of the type normally associated with beer, water, soda. Most preferably the invention concerns beer glasses, preferably plastic beer glasses. Even more preferably the beer glasses have substantially the known standard 'pilsner' form. Other forms are also envisaged such as tumblers, pint glasses, steins, weizen glasses and stanges. It is preferred that the drinking vessel tapers in diameter from the rim to the base, giving a typical pilsner beer glass form, however, substantially vertical, or substantially curved, vessel bodies can be envisaged.

In its most convenient form the stackable drinking vessel has a substantially circular cross-section at least at the rim and the base of the drinking vessel since this is most acceptable for drinking and stacking. It is envisaged that the vessel body of the drinking vessel may be partly or fully elliptical, or may have a polygonal cross-section, however, it is most preferred that it is circular in cross-section.

The stackable vessel of the invention preferably has a height of from 5 cm to 30 cm tall, more preferably from 8 cm to 20 cm, and most preferably from 10 cm to 18 cm.

It is preferable that drinking vessels in a stack have the same height. However, the possibility of stacking rows of drinking vessels of a different heights is not excluded.

The drinking vessel preferably has a containment volume of from 10 cl to 100 cl, for drinking vessels having volumes outside this range the convenience of stacking is likely to be reduced. More preferably the volume is from 10 cl to 800 cl, even more preferably from 20 cl to 600 cl and most preferably from 25 cl to 550 cl.

It is preferred that as well as being stackable the drinking vessels are nestable within one another. This allows for easy storage and transport. This is conveniently achieved with a drinking vessel that tapers from rim to base whereby the vessel body of one drinking vessel can be fitted into the containment volume of the vessel body of another vessel.

Although not preferred it is possible that the drinking vessel may be provided with additional components such as for example a handle, that may be detachable. A handle may be useful for example if the vessels in the stack are close to one another, and one cannot grip a drinking vessel directly.

According to another aspect of the invention there is provided a stack of drinking vessels comprising at least two layers, wherein each drinking vessel comprises a rim at an open end of the drinking vessel, and a base comprising stack elements able to simultaneously engage with at least a rim of a first drinking vessel in a layer below and with a second drinking vessel in the layer below.

The drinking vessels in the stack mate in a base to rim manner so that the inner volume of the drinking vessels is not substantially impeded by the stacking. This allows the drinking vessels to be filled with beverage when in stacked formation.

The minimum size of the stack is three drinking vessels, whereby a first layer of two drinking vessels supports a second layer of a single drinking vessel, the stack elements of the base of the second layer drinking vessel engaging the rims of the first layer drinking vessels.

Beyond the minimum size stack, further drinking vessels can be added to the layers and additional layers may be added.

For the sake of convenience of hand carrying the stack, the first (i.e. the lowest) layer preferably contains two drinking vessels; one per hand. However, a first layer containing just a single drinking vessel may be used in a 1:2:1 layer construction. Possibly more than two drinking vessels may be provided in the first layer, the maximum number being limited by the practicalities of carrying the stack by hand.

It is a preferred embodiment that each layer of the of the stack beyond the first layer is constructed according to formula I or formula II.

$$n_i = n_{i-1} + 1 \quad \text{I}$$

$$n_i = n_{i-1} - 1 \quad \text{II}$$

wherein $n_i$ is number of drinking vessels in layer T, and $n_{i-1}$ is the number of drinking vessels in the layer immediately preceding layer T.

Preferred stacks have constructions of: 1:2:1, 2:1, 1:2:3:2, 2:3:2, 1:2:3:2:1, 2:3:2:1, and 2:3:2:3:2:1.

Preferably adjacent drinking vessels in any particular layer 'i' of the stack are engaged with the lower (i−1) and/or upper (i+1) layer drinking vessels so as to be diametrically opposed. In this manner the drinking vessels are constructed into a stack that has a substantially planar form and is easy to carry by hand.

As discussed above in relation to the drinking vessels in general, the engagement mechanism of the drinking vessels comprises at least two grooves provided in the base of each drinking vessel. The grooves and rims of the drinking vessels are shaped to closely mate for stable stacking, allowing one drinking vessel to stack its base onto the rims of at least two other drinking vessels.

The stacking mechanism of the invention is useful in providing a stable stack of drinking vessels, especially when the drinking vessels contain beverages, which can be carried by hand, i.e. without use of a tray or similar carrying aid not forming an integral or permanently joined part of the drinking vessels.

The preferred forms of the drinking vessels, including the base, rims, grooves, etc. are discussed in detail above.

According to another aspect of the invention there is provided a method of serving beverages comprising providing a stack of drinking vessels as discussed above filled with beverage to a consumer.

In the present specification the term "similar drinking vessel" refers to a drinking vessel substantially the same as the subject drinking vessel. In particular, in that at least the rim and base of the similar drinking vessel are the same as that of the subject drinking vessel so as to allow stacking of the vessels with one another. Preferably the similar drinking vessels are identical in physical form to the subject drinking vessel. The term 'physical form' excludes surface decorations such that similar drinking vessels may differ in terms of aesthetic appearance.

BRIEF DESCRIPTION OF THE DRAWINGS

The features and advantages of the invention will be appreciated upon reference to the following drawings, in which.

DESCRIPTION OF ILLUSTRATIVE EMBODIMENTS

The following is a description of certain embodiments of the invention, given by way of example only and with reference to the drawings.

Figure 1:
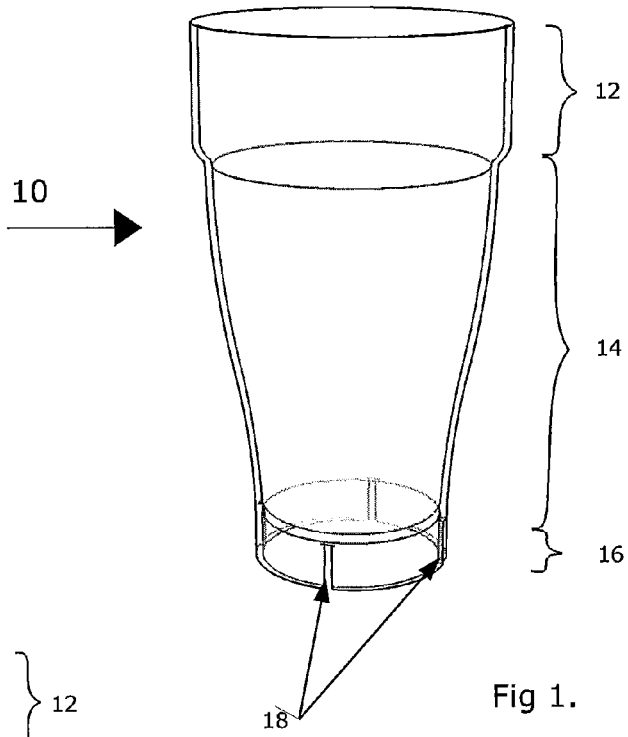
FIG. 1 is a perspective view of a drinking vessel according to the present invention.
Figure 2:
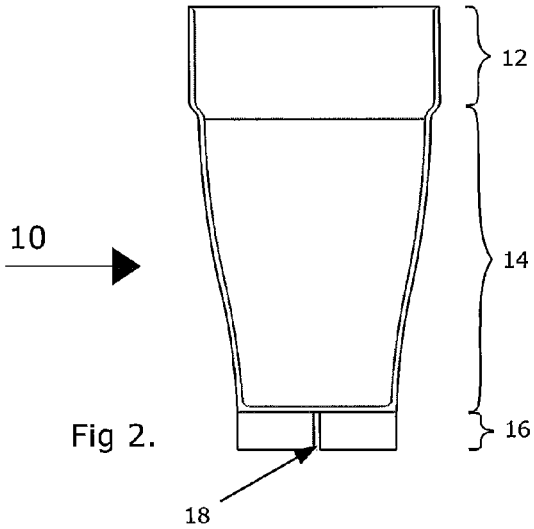
FIG. 2 is a cross-sectional view of a drinking vessel according to the present invention.
Figure 3:
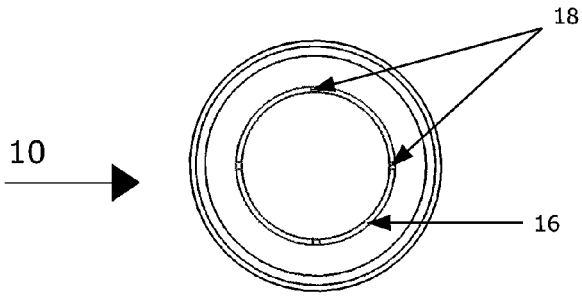
FIG. 3 is a bottom view of a drinking vessel according to the present invention.

Referring to FIGS. 1, 2 and 3 there is shown a stackable drinking vessel 10 in the form of a stackable pilsner type beer glass. The drinking vessel 10 has a rim 12 in the form of a side wall extending vertically, upwardly from its vessel body 14. The rim 12 forms an open end of the drinking vessel. The vessel body 14 tapers downwardly to its bottom and forms the main containment volume of the drinking vessel. Extending vertically downwardly from the bottom of the vessel body 14 is a base 16. The base 16 is provided with four stack elements in the form of grooves embodied as slots 18. The slots 18 are sized and shaped to mate with a rim 12 of another similar stackable drinking vessel 10 to allow stacking as for example illustrated in FIG. 4.

The illustrated example drinking vessel 10 has a total height of 14.1 cm, of which the rim 12 is 3 cm tall, the base 16 is 1.2 cm tall and the vessel body 14 is 9.9 cm tall. The diameter at the open end of the rim 12 is 8.1 cm and the diameter at the lowest part of the base is 5.1 cm. The slots 18 extend vertically the full height of the base 16 and so extend approximately 8.5% of the total height of the vessel. Such a depth of the slots 18 allows a good portion of a rim 12 to be received therein for stable stacking.

Figure 4:
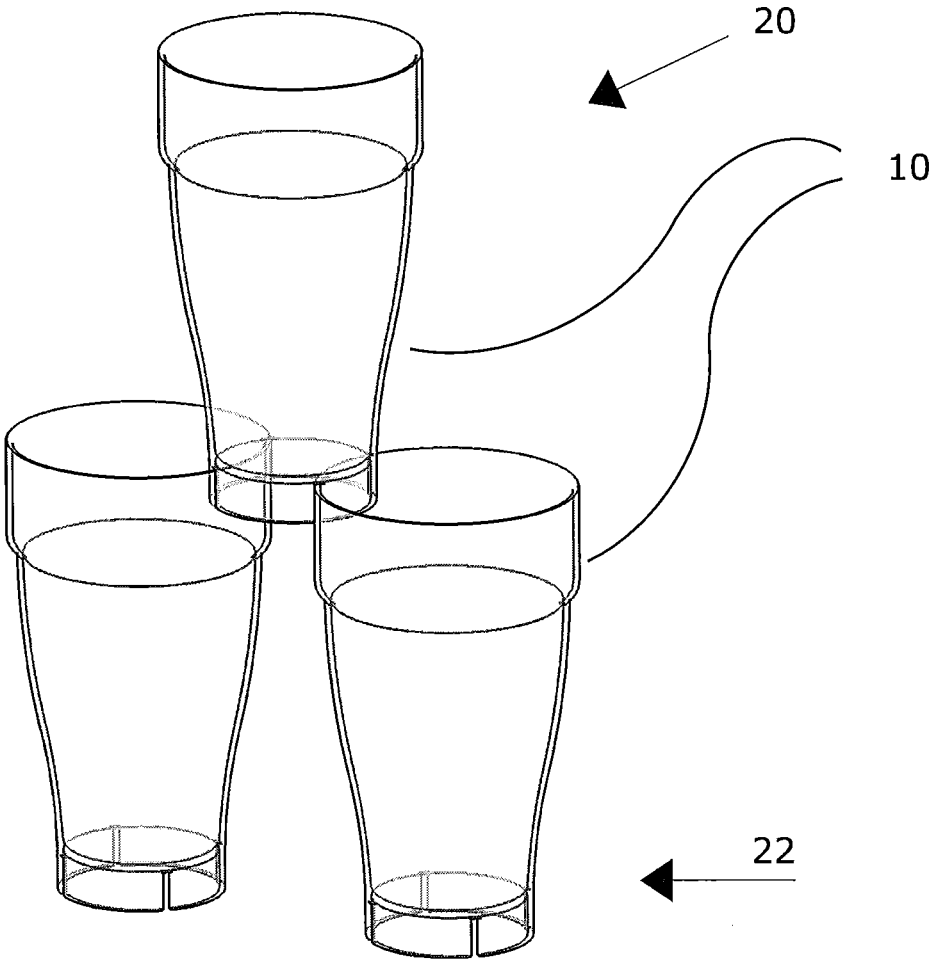
FIG. 4 is a perspective view of a stack of rim to base stacked drinking vessels according to the invention.

FIG. 4 shows a rim to base type stack 20 of 3 drinking vessels 10 layered in the form 2:1. Each of the drinking vessels 10 can be filled with beverage such as beer (not shown). The stack can be conveniently carried by hand, i.e. without the use of a tray or other additional aids, by grasping the two drinking vessels 10 in the lowest layer 22 of the stack 20 and lifting. As a result of the engagement of the slots 18 with the rims 12 the stack is 20 stable enough to carry by hand.

Figure 5:
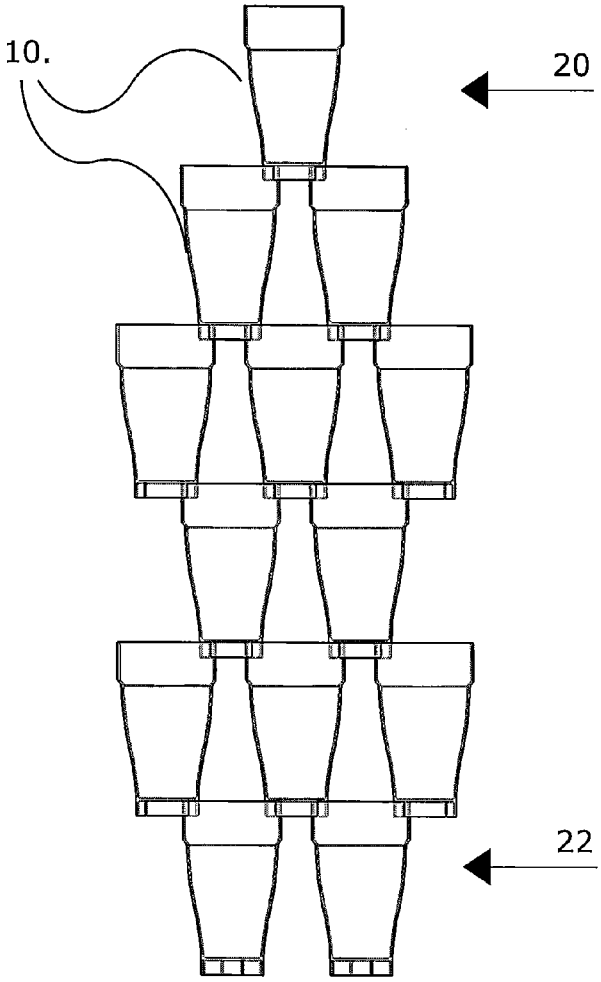
FIG. 5 is a perspective view of a stack of rim to base stacked drinking vessels according to the invention.

FIG. 5 shows a rim to base type stack 20 of 13 drinking vessels 10 layered in the form 2:3:2:3:2:1. Such as stack can also be hand carried similarly to the stack illustrated in FIG. 4.

Figure 6:
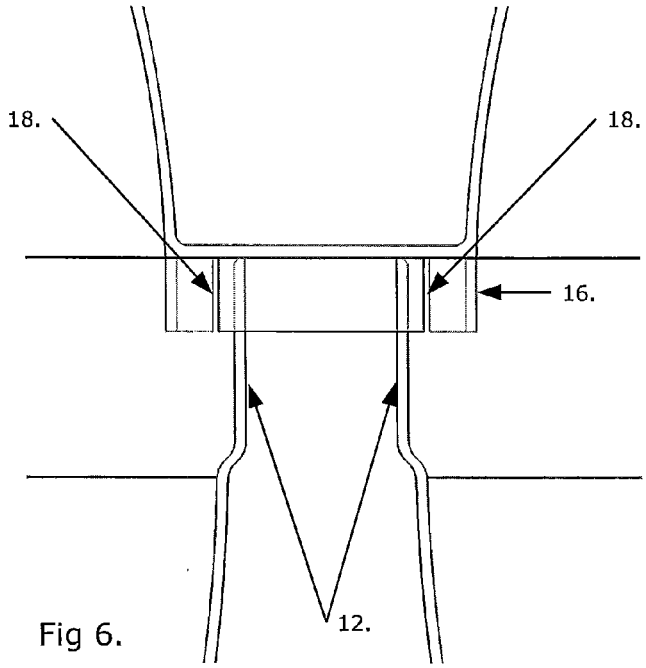
FIG. 6 is a partial perspective view of stacked drinking vessels.

As can be seen more clearly in FIG. 6, the rim 12 of a lower drinking vessel 10 closely fits into two of the slots 18 in the base 16 of a drinking vessel in a layer above. This connection firmly holds the upper drinking vessel 10 thus preventing it from toppling and also holds the lower two drinking vessels 10 laterally together. This latter feature adds stability to higher layers in the stack 20.

The slots 18 are positioned and the drinking vessels 10 slotted therein so that adjacent drinking vessels 10 in a layer are diametrically opposed about the rim 12 and/or base 16 of the drinking vessels 10 with which they are stacked. As can be seen if FIGS. 4 and 5, this leads to substantially planar stack 20.

Figure 7:
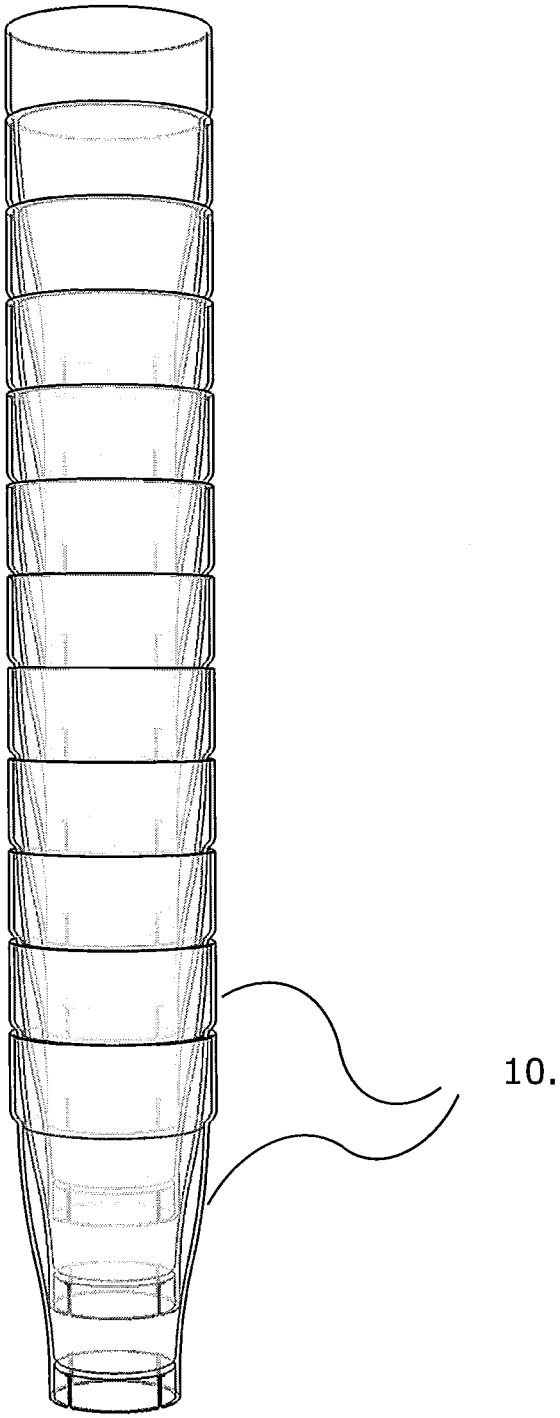
FIG. 7 is a perspective view of a plurality of nested drinking vessels.
Figure 8:
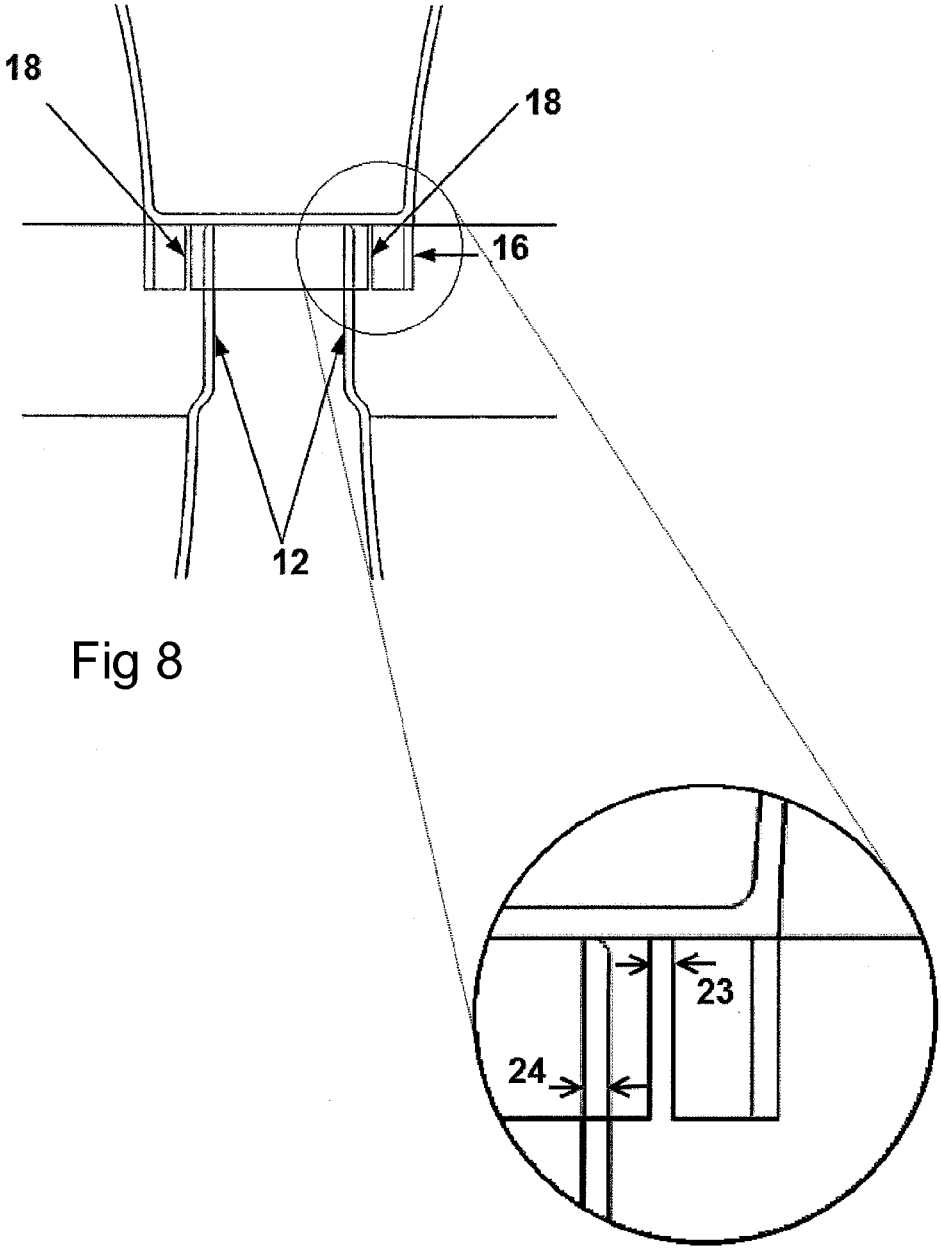
FIG. 8 shows the partial perspective view of FIG. 6 and an enlarged view of a section thereof.

FIG. 7 shows a plurality of drinking vessels 10 nested for storage.

Thus, the invention has been described by reference to certain embodiments discussed above. It will be recognized that these embodiments are susceptible to various modifications and alternative forms well known to those of skill in the art. Modifications may be made to the structures and techniques described herein without departing from the spirit and scope of the invention. Accordingly, although specific embodiments have been described, these are examples only and are not limiting upon the scope of the invention.

What is claimed is:

1. A stackable drinking vessel comprising a rim at an open end of the vessel, a base, and a vessel body between the rim and the base, wherein the base comprises stack-elements simultaneously engageable with at least a rim of a first similar drinking vessel and a rim of a second similar drinking vessel, whereby the vessel stacks in a substantially planar form upon the two similar drinking vessels; wherein the stack-elements comprise at least two grooves in the base of the drinking vessel, the grooves having dimensions to receive a single rim of a similar drinking vessel, and wherein the at least two grooves have a width substantially equal to a thickness of the rim.

2. The stackable drinking vessel according to claim 1, wherein the cross-section of at least the rim and the base of the drinking vessel is substantially circular.

3. The stackable drinking vessel according to claim 1, wherein the rim extends substantially vertically, downwardly.

4. The stackable drinking vessel according to claim 1, wherein the vessel body is substantially tapered from the rim to the base.

5. The stackable drinking vessel according to claim 1, wherein the base extends substantially vertically, upwardly.

6. The stackable drinking vessel according to claim 1, wherein the grooves extend upwardly for between 1% to 20% of the total height of the drinking vessel.

7. The stackable drinking vessel according to claim 1, wherein the grooves are from 0.3 mm to 5 mm wide.

8. The stackable drinking vessel according to claim 7, wherein the rim is from 0.2 mm to 5 mm thick.

9. The stackable drinking vessel according to claim 1, wherein the grooves have a recess shape at least partially complementary to that of the rim of the drinking vessel.

10. The stackable drinking vessel according to claim 1, wherein the drinking vessel is from 5 cm to 30 cm tall.

11. The stackable drinking vessel according to claim 1, wherein the drinking vessel has a contents volume of from 10 cl to 100 cl.

12. The stackable drinking vessel according to claim 1, wherein the stack elements comprise two pairs of diametrically opposed grooves.

13. The stackable drinking vessel according to claim 12, wherein the stack elements comprise two pairs of diametrically opposed grooves, the first diametrically opposed pair being aligned in a direction that deviates from the second diametrically opposed pair by substantially 90 degrees.

14. A stack of drinking vessels comprising at least two layers, wherein each drinking vessel comprises a rim at an open end of the drinking vessel, and a base comprising stack elements positioned to form a substantially planar stack and able to simultaneously engage with at least a rim of a first drinking vessel in a layer below and with a second drinking vessel in the layer below; wherein the stack-elements comprise at least two grooves in the base of the drinking vessel, the grooves having dimensions to receive a single rim of a similar drinking vessel, and wherein the at least two grooves have a width substantially equal to a thickness of the rim.

15. The stack of drinking vessels according to claim 14, comprising from 3 to 22 drinking vessels.

16. The stack of drinking vessels according to claim 14 wherein each layer of the stack beyond a first layer is constructed according to formula ($n_i = n_i - 1 + 1$) or formula ($n_i = n_i - 1 - 1$), wherein $n_i$ is the number of drinking vessels in a layer T, and $n_i - 1$ is the number of drinking vessels in the layer immediately preceding layer 'i'.

17. The stack of drinking vessels according to claim 14 wherein drinking vessels within a single layer are stacked with and upon the above and below drinking vessels so as to be diametrically opposed.

18. A method of serving beverages comprising providing a stack of drinking vessels at least partially filled with beverage to a consumer, wherein the stack of drinking vessels comprises at least two layers, wherein each drinking vessel comprises a rim at an open end of the drinking vessel, and a base comprising stack elements positioned to form a substantially planar stack and able to simultaneously engage with at least a rim of a first drinking vessel in a layer below and with a second drinking vessel in the layer below, wherein the stack-elements comprise at least two grooves in the base of the drinking vessel, the grooves having dimensions to receive a single rim of a similar drinking vessel, and wherein the at least two grooves have a width substantially equal to a thickness of the rim.

* * * * *